US006031210A

United States Patent [19]

Wonka

[11] Patent Number: 6,031,210

[45] Date of Patent: Feb. 29, 2000

[54] ELECTRICAL CIRCUIT FOR SUPPLYING POWER

[75] Inventor: Boris Wonka, Neu-Isenburg, Germany

[73] Assignee: Braun Aktiengesellschaft, Frankfurt, Germany

[21] Appl. No.: 09/202,637

[22] PCT Filed: Aug. 8, 1997

[86] PCT No.: PCT/EP97/04313

§ 371 Date: Dec. 17, 1998

§ 102(e) Date: Dec. 17, 1998

[87] PCT Pub. No.: WO98/06296

PCT Pub. Date: Feb. 19, 1998

[30] Foreign Application Priority Data

Aug. 8, 1996 [DE] Germany ..... 196 32 029

[51] Int. Cl.[7] ..... H05B 1/02

[52] U.S. Cl. ..... 219/483; 219/501; 219/508; 307/117

[58] Field of Search ..... 219/508–512, 219/505, 492, 501, 502, 497; 307/117

[56] References Cited

FOREIGN PATENT DOCUMENTS

| | | |
|---|---|---|
| 31 33 325 | 9/1982 | Germany . |
| 33 02 609 | 8/1984 | Germany . |
| 195 34 105 A 1 | 3/1996 | Germany . |

*Primary Examiner*—Mark Paschall
*Attorney, Agent, or Firm*—Fish & Richardson P.C.

[57] ABSTRACT

The invention is directed to an electric circuit configuration (1) for an electrical load, in particular for an electric hair dryer, a fan heater or the like. The circuit configuration (1) comprises two heating resistors (2, 6) in parallel arrangement, of which the second heating resistor (6) is equipped with a serial switch (5). The two heating resistors (2, 6) may be connected to an a.c. source. Furthermore, provision is made for a d.c. fan motor (11) connected to one of the two heating resistors (2) via a rectifier circuit (7). The rectifier circuit (7) includes two rectifiers (8, 9) in antiparallel arrangement having connected to their junction (10) one of the connecting points of the d.c. fan motor (11). The other connecting point of the d.c. fan motor (11) is connected to the second heating resistor (6) which is equipped with the serial switch (5).

10 Claims, 2 Drawing Sheets

ELECTRICAL CIRCUIT FOR SUPPLYING POWER

BACKGROUND OF INVENTION

This invention relates to an electric circuit configuration for an electrical load, in particular for an electric hair dryer, a fan heater or the like, with two first and second resistors in parallel arrangement, of which at least one is a second heating resistor and the other particularly a first heating resistor, with a switch, provision being made for an a.c. source adapted to be connected to the resistors, and with a d.c. fan motor connected to one of the resistors via a rectifier circuit.

A circuit configuration of this type is known from German Offenlegungsschrift DE 31 33 325 A1. In this specification, the fan motor is inserted in the center branch of a diode rectifier bridge connected to taps of the two heating resistors on the one side and to a terminal of the a.c. supply on the other side. Switching contacts are provided to connect the two heating resistors to the other terminal of the a.c. supply. When only one switching contact is closed, both half-waves of the alternating current flow through one of the two heating resistors, while the fan motor receives only one half-wave. By contrast, with both switching contacts closed, both half-waves of the alternating current flow through both heating resistors, the fan motor receiving likewise both half-waves. Accordingly, when only one switching contact is closed, only part of the heating power and fan power is available, while full power is achieved when both switching contacts are closed.

SUMMARY OF INVENTION

It is an object of the present invention to improve upon the electric circuit configuration of the type initially referred to while maintaining the advantageous function in such manner that the circuit configuration is simpler and more economical in construction, involving in particular a reduced number of electrical components.

According to the present invention, this object is accomplished by providing the rectifier circuit with only two rectifiers in antiparallel arrangement having connected to their junction one of the connecting points of the d.c. fan motor.

The rectifier circuit of the present invention is reduced to two rectifiers only. This amounts to a reduction in the number of requisite electrical components, producing significant cost savings particularly where a mass product such as a hair dryer or a fan heater is involved. The function of the circuit configuration is however maintained unchanged. Furthermore, the closing of the switch referred to has the effect of providing the full heating power and the full fan power.

In an advantageous aspect of the present invention, the other connecting point of the d.c. fan motor is connected to the second heating resistor which is equipped with the serial switch. This results in a particularly simple and convenient circuit arrangement.

In an advantageous embodiment of the present invention, the two rectifiers are connected to two taps on the first heating resistor. The location of the two taps on the first heating resistor may be freely selected. Thus it is possible, by suitable selection of the tappings, to vary the voltage residing at the d.c. fan motor.

In another advantageous embodiment of the present invention, the two rectifiers are connected to a tap as well as to a low end of the first heating resistor. The location of the one tap on the first heating resistor is freely selectable. This enables the voltage residing at the d.c. fan motor to be varied.

Particularly conveniently, the connecting point of the d.c. fan motor connected to the second heating resistor is connected to a tap on the second heating resistor located symmetrically to the two taps or, as the case may be, symmetrically to the tap and the low end on the first heating resistor to which the two rectifiers are connected. As the result, the voltage residing at the d.c. fan motor is approximately of like magnitude during both half-waves of the alternating current.

Still further it is particularly suitable for the two taps or, where applicable, for the one tap to be symmetrically arranged with respect to the low ends of the first heating resistor. In this manner, the first heating resistor is exposed to equal loads during both half-waves of the alternating current.

In another embodiment of the present invention, the two rectifiers are connected to the two opposed low ends of the heating resistor. The effect thereby achieved is that the maximum available voltage resides at the d.c. fan motor.

Particularly conveniently, the d.c. fan motor's connecting point which is connected to the heating resistor is connected to a center tap on the second heating resistor. As the result, the second heating resistor is exposed to equal loads during both half-waves of the alternating current.

Further features, advantages and application possibilities of the present invention will become apparent from the subsequent description of embodiments illustrated in more detail in the accompanying drawing. It will be understood that any single feature and any combination of single features described and/or represented by illustration form the subject-matter of the present invention, irrespective of their summary in the claims and their back-reference.

DETAILED DESCRIPTION OF INVENTION

Figure 1:
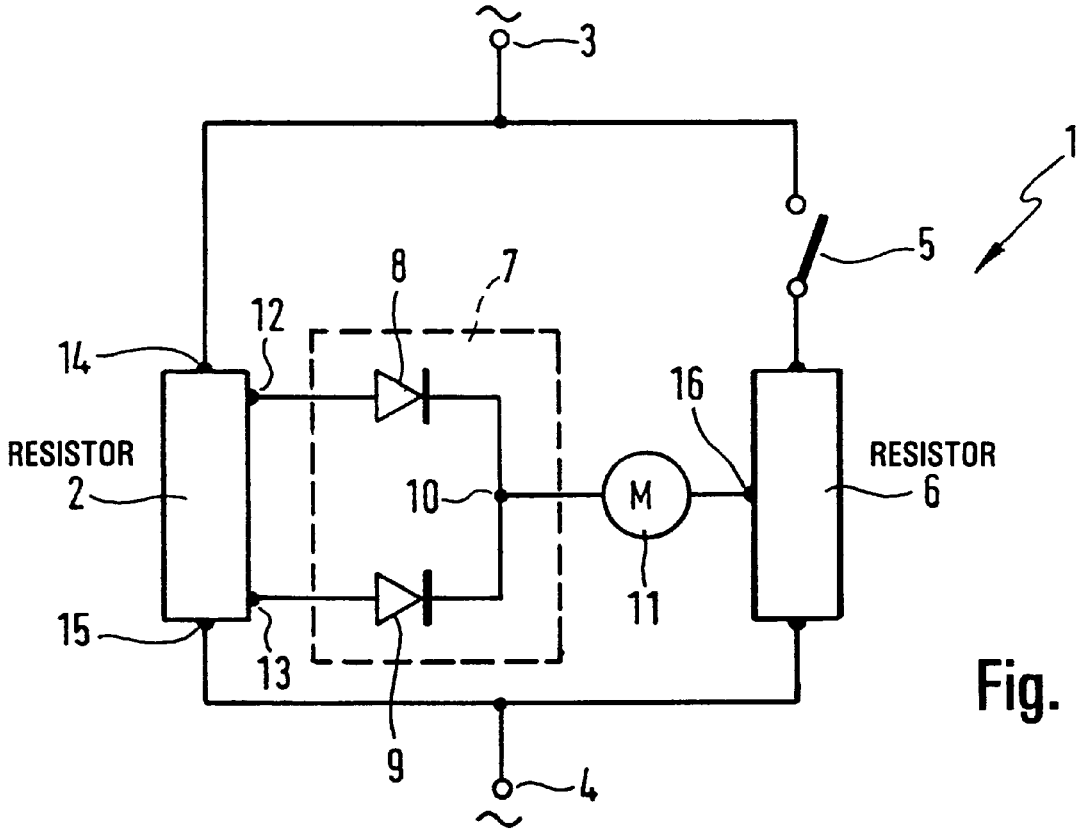
FIG. 1 is a schematic diagram of a circuit configuration of the present invention illustrating a first embodiment thereof.

Referring now to FIG. 1, there is shown an electric circuit configuration 1 having a first heating resistor 2 inserted between terminals 3, 4 of an a.c. source. Connected between the terminals 3, 4 of the a.c. source and parallel to the first heating resistor 2 is a series arrangement comprised of a switch 5 and a second heating resistor 6. The two heating resistors 2, 6 are of approximately like configuration, producing in particular about the same heating power.

A rectifier circuit 7 includes two rectifiers 8, 9, in particular two diodes, connected in anti-parallel arrangement. Connected to the junction 10 of the two rectifiers 8, 9 is one of the connecting points of a d.c. fan motor 11.

The still unassigned connecting points of the two rectifiers 8, 9 are connected to two taps 12, 13 on the first heating resistor 2 which are each located at about the same distance from the associated low end 14, 15 of the first heating resistor 2. This distance amounts, for example, to about 10 per cent of the total length of the first heating resistor 2. The still unassigned connecting point of the d.c. fan motor 11 is connected to a tap 16 on the second heating resistor 6 at a location approximately in the center of the second heating resistor 6.

With the switch 5 open, alternating current flows between the terminals 3, 4 of the a.c. source in both directions through the first heating resistor 2. The alternating current of the first half-wave further flows from the terminal 3 through part of the first heating resistor 2, the tap 12, the rectifier 8, the junction 10, the d.c. fan motor 11, the tap 16 and through half of the second heating resistor 6 to the terminal 4 of the a.c. source. By reason of the open condition of the switch 5, alternating current does not flow during the opposed second half-wave from the terminal 4 through the d.c. fan motor 11 to the terminal 3 of the a.c. source.

With the switch 5 closed, alternating current flows between the terminals 3, 4 of the a.c. source in both directions through the first heating resistor 2 and through the second heating resistor 6 as well. The alternating current of the first half-wave flows from the terminal 3 through part of the first heating resistor 2, the tap 12, the rectifier 8, the junction 10, the d.c. fan motor 11, the tap 16 and through half of the second heating resistor 6 to the terminal 4 of the a.c. source. By reason of the closed condition of the switch 5, alternating current also flows during the opposed second half-wave from the terminal 4 through part of the first heating resistor 2, the tap 13, the rectifier 9, the junction 10, the d.c. fan motor 11, the tap 16 and through half of the second heating resistor 6 to the terminal 3 of the a.c. source.

Hence, with the switch 5 open, alternating current flows only through the first heating resistor 2, while with the switch 5 closed alternating current flows through both the first heating resistor 2 and the second heating resistor 6. The heating power is thus greater with the switch 5 closed than it is when the switch 5 is open.

With the switch 5 open, only one half-wave of the alternating current flows through the d.c. fan motor 11, while with the switch 5 closed the alternating current of both half-waves flows through the d.c. fan motor 11. The fan's power output is thus greater with the switch 5 closed than it is when the switch 5 is open.

The voltage dropping across the d.c. fan motor 11 is adjustable by means of the taps 12, 13. The longer the path from the low ends 14, 15 to the associated taps 12, 13, the lower the voltage present at the d.c. fan motor 11. This feature can be utilized for adjustment of the requisite operating voltage in particular in the use of low-voltage fan motors.

By virtue of the symmetrical arrangement of the taps 12, 13 with respect to the tap 16, the voltage drop across the d.c. fan motor 11 is identical during both half-waves. Because of the symmetrical arrangement of the taps 12, 13 with respect to the heating resistor 2, this heating resistor 2 is exposed to equal loads during both half-waves. The symmetrical arrangement of the tap 16 with respect to the heating resistor 6 causes this heating resistor 6 to be exposed to equal loads during both half-waves.

Figure 2:
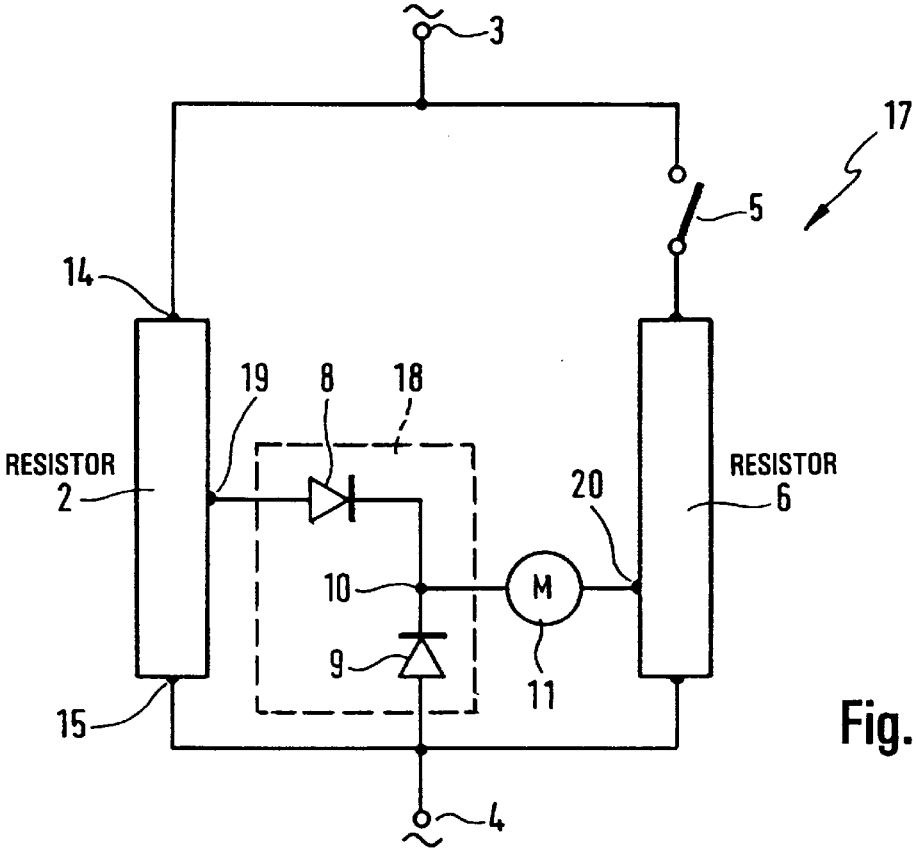
FIG. 2 is a schematic diagram of a circuit configuration of the present invention illustrating a second embodiment thereof.

FIG. 2 shows an electric circuit configuration 17 corresponding essentially to the circuit configuration 1 of FIG. 1. Therefore, like reference characters identify like electrical components.

The circuit configuration 17 of FIG. 2 differs from the circuit configuration 1 of FIG. 1 by a different rectifier circuit 7. In the rectifier circuit 18 of the circuit configuration 17 of FIG. 2, the free connecting point of the rectifier 8 is connected to a tap 19 on the first heating resistor 2 at a location approximately in the center of the heating resistor 2. The free connecting point of the rectifier 9 is connected to the low end 15 of the first heating resistor 2. The free connecting point of the d.c. fan motor 11 is connected to a tap 20 on the second heating resistor 6 at a location amounting to about 25 per cent of the total length of the second heating resistor 6.

With the switch 5 open, alternating current flows between the terminals 3, 4 of the a.c. source in both directions, passing through the first heating resistor 2. The alternating current of the first half-wave further flows from the terminal 3 through half of the first heating resistor 2, the tap 19, the rectifier 8, the junction 10, the d.c. fan motor 11, the tap 20 and through part of the second heating resistor 6 to the terminal 4 of the a.c. source. By contrast, because of the open condition of the switch 5, alternating current does not flow during the opposed second half-wave from the terminal 4 through the d.c. fan motor 11 to the terminal 3 of the a.c. source.

With the switch 5 closed, alternating current flows between the terminals 3, 4 of the a.c. source in both directions through the first heating resistor 2 and through the second heating resistor 6 as well. The alternating current of the first half-wave flows from the terminal 3 through half of the first heating resistor 2, the tap 19, the rectifier 8, the junction 10, the d.c. fan motor 11, the tap 20 and through part of the second heating resistor 6 to the terminal 4 of the a.c. source. By reason of the closed condition of the switch 5, alternating current also flows during the opposed second half-wave from the terminal 4 through the low end 15, the rectifier 9, the junction 10, the d.c. fan motor 11, the tap 20 and through part of the second heating resistor 6 to the terminal 3 of the a.c. source.

Hence, with the switch 5 open, alternating current flows only through the first heating resistor 2, while with the switch 5 closed alternating current flows through both the first heating resistor 2 and the second heating resistor 6. The heating power is thus greater with the switch 5 closed than it is when the switch 5 is open.

With the switch 5 open, only one half-wave of the alternating current flows through the d.c. fan motor 11, while with the switch 5 closed the alternating current of both half-waves flows through the d.c. fan motor 11. The fan's power output is thus greater with the switch 5 closed than it is when the switch 5 is open.

The voltage dropping across the d.c. fan motor 11 is adjustable by means of the taps 19, 20. By virtue of the symmetrical arrangement of the tap 20 with respect to the tap 19 and the low end 15, the voltage drop across the d.c. fan motor 11 is identical during both half-waves. The symmetrical arrangement of the tap 19 with respect to the heating resistor 2 causes this heating resistor 2 to be exposed to equal loads during both half-waves. Owing to the asymmetrical arrangement of the tap 20 with respect to the heating resistor 6, this heating resistor 6 is exposed to unequal loads during both half-waves.

Figure 3:
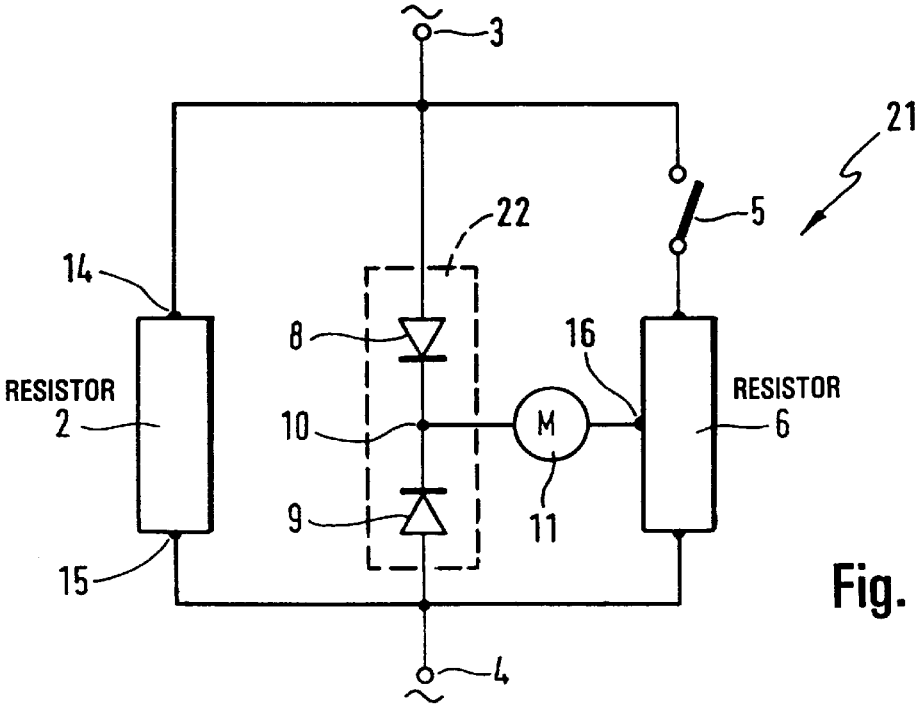
FIG. 3 is a schematic diagram of a circuit configuration of the present invention illustrating a third embodiment thereof.

FIG. 3 illustrates an electric circuit configuration 21 which corresponds essentially to the circuit configuration 1 of FIG. 1. Therefore, like reference characters identify like electrical components.

The circuit configuration 21 of FIG. 3 differs from the circuit configuration 1 of FIG. 1 by a different rectifier circuit 7. In the rectifier circuit 22 of the circuit configuration 21 of FIG. 3, the free connecting point of the rectifier 8 is connected to the low end 14 of the first heating resistor 2.

The free connecting point of the rectifier 9 is connected to the low end 15 of the first heating resistor 2. The free connecting point of the d.c. fan motor 11 is connected to the tap 16 on the second heating resistor 6 at a location amounting to about half of the second heating resistor 6.

With the switch 5 open, alternating current flows between the terminals 3, 4 of the a.c. source in both directions, passing through the first heating resistor 2. The alternating current of the first half-wave further flows from the terminal 3 through the low end 14, the rectifier 8, the junction 10, the d.c. fan motor 11, the tap 16 and through half of the second heating resistor 6 to the terminal 4 of the a.c. source. By contrast, because of the open condition of the switch 5, alternating current does not flow during the opposed second half-wave from the terminal 4 through the d.c. fan motor 11 to the terminal 3 of the a.c. source.

With the switch 5 closed, alternating current flows between the terminals 3, 4 of the a.c. source in both directions through the first heating resistor 2 and through the second heating resistor 6 as well. The alternating current of the first half-wave flows from the terminal 3 through the low end 14, the rectifier 8, the junction 10, the d.c. fan motor 11, the tap 16 and through half of the second heating resistor 6 to the terminal 4 of the a.c. source. By reason of the closed condition of the switch 5, alternating current also flows during the opposed second half-wave from the terminal 4 through the low end 15, the rectifier 9, the junction 10, the d.c. fan motor 11, the tap 16 and through half of the second heating resistor 6 to the terminal 3 of the a.c. source.

Hence, with the switch 5 open, alternating current flows only through the first heating resistor 2, while with the switch 5 closed alternating current flows through both the first heating resistor 2 and the second heating resistor 6. The heating power is thus greater with the switch 5 closed than it is when the switch 5 is open.

With the switch 5 open, only one half-wave of the alternating current flows through the d.c. fan motor 11, while with the switch 5 closed the alternating current of both half-waves flows through the d.c. fan motor 11. The fan's power output is thus greater with the switch 5 closed than it is when the switch 5 is open.

By virtue of the symmetrical arrangement of the tap 16 with respect to the low ends 14, 15, the voltage drop across the d.c. fan motor 11 is identical during both half-waves. Because of the symmetrical arrangement of the tap 16 with respect to the heating resistor 6, this heating resistor 6 is exposed to equal loads during both half-waves.

The circuit configurations 1, 17, 21 of FIGS. 1 to 3 may be utilized to particular advantage in an electric hair dryer or in an electric fan heater. In this case, the d.c. fan motor 11 serves the function of generating an air stream, and the two heating resistors 2, 6 operate to heat this air stream. By means of the switch 5, it is then possible to switch between a lower fan setting producing a reduced amount of heat and a higher fan setting producing an increased amount of heat. Using a second switch not shown which may be connected either in series with the first heating resistor 2 or in series with the parallel arrangement of the two heating resistors 2, 6, the circuit configurations 1, 17, 21 of FIGS. 1 to 3 may be switched on and off.

In the preferred embodiments, provision is made for a first and a second heating resistor (2, 6). In a modification of these embodiments, resistors may be substituted for these heating resistors such that in total at least one heating resistor remains in the circuit configuration. It is possible for the respective heating resistor of FIGS. 1 to 3 to be replaced with a corresponding resistance component wholly or in part. In a further modification, the resistance component is configured as a single resistor or as several resistors connected in series. Where a series arrangement of resistors is used in lieu of a heating resistor, the electrical connecting points to the d.c. fan motor (11) or to the diode rectifiers (8, 9) have to be located between the series-connected resistors in such manner that for all operating modes no excessive power resides at the electrical components. Among other approaches, this is accomplished by selecting the resistance values in accordance with the positions of the electrical connecting points (12, 13, 16, 19, 20) in FIGS. 1 to 3.

Preferably, the second heating resistor (6) is replaced in FIG. 1 or FIG. 3 with two series-connected resistors of like resistance, or in FIG. 2 with two series-connected resistors having a resistance ratio of ⅓ to ⅔ of the resistance value of the original heating resistor (6).

Using only one instead of two heating resistors, it is possible, for example, to make additional provision for a cold or cool setting instead of several switchable heat settings.

What is claimed is:

1. An electric circuit for an electrical load, comprising:

first and second heating resistors connected in parallel with each other;

a.c. terminals for connecting the first and second heating resistors to an a.c. source;

a rectifier circuit; and a.d.c. fan motor electrically connected to the second heating resistor via the rectifier circuit, said d.c. fan motor having two connecting points, wherein the rectifier circuit includes only two rectifiers, said only two rectifiers connected in a back-to-back arrangement at a common junction, wherein one of the two connecting points of the d.c. fan motor is electrically connected to said common junction and the other of said two connecting points of the d.c. fan motor is electrically connected to the second heating resistor.

2. The electric circuit configuration of claim 1, further comprising a switch that is series-connected to the second heating resistor.

3. The electric circuit configuration of claim 1 wherein the first heating resistor has two taps and said only two rectifiers are electrically connected between the two taps on the first heating resistor.

4. The electric circuit configuration of claim 1, wherein the first heating resistor has an intermediate tap, a first end lead and a second end lead and said only two rectifiers are electrically connected between the tap and the first end lead of the first heating resistor.

5. The electric circuit configuration of claim 3, wherein the second heating resistor includes a tap located symmetrically with respect to the two taps on the first heating resistor and said other of two connecting points of the d.c. fan motor is electrically connected to the tap on the second heating resistor.

6. The electric circuit configuration of claim 4, wherein said second tap is symmetrically arranged with respect to the first and second end leads of the first heating resistor.

7. The electric circuit configuration of claim 1, wherein the first heating resistor has first and second end leads and said only two rectifiers are electrically connected to the first and second end leads of the first heating resistor.

8. The electric circuit configuration of claim 1, wherein said second heating resistor has a center tap and the d.c. fan motor is electrically connected to the second heating resistor through the center tap on the second heating resistor.

9. The electric circuit configuration of claim 3, wherein the first heating resistor has first and second end leads and said two taps of the first heating resistor are symmetrically arranged with respect to the first and second end leads of the first heating resistor.

10. The electric circuit configuration of claim 4, wherein the second heating resistor includes a tap located symmetrically with respect to the tap and the low end on the first heating resistor and said other of two connecting points of the d.c. fan motor is electrically connected to the tap on the second heating resistor.

* * * * *